US007798114B2

(12) United States Patent
McElwee et al.

(10) Patent No.: US 7,798,114 B2
(45) Date of Patent: Sep. 21, 2010

(54) VALVE TRAIN ASSEMBLY WITH MAGNET

(75) Inventors: Mark McElwee, Lake Orion, MI (US); Jermel Jones, Southfield, MI (US); Peter Sailer, Erlangen (DE); Oliver Schnell, Veitsbronn (DE)

(73) Assignees: Schaeffler KG, Herzogenaurach (DE); Chrysler Group LLC, Auburn Hills, MI (US)

( * ) Notice: Subject to any disclaimer, the term of this patent is extended or adjusted under 35 U.S.C. 154(b) by 366 days.

(21) Appl. No.: 12/028,608

(22) Filed: Feb. 8, 2008

(65) Prior Publication Data

US 2008/0190391 A1 Aug. 14, 2008

Related U.S. Application Data

(60) Provisional application No. 60/889,010, filed on Feb. 9, 2007.

(51) Int. Cl.
*F01L 1/18* (2006.01)

(52) U.S. Cl. ..... 123/90.44; 123/90.46; 123/90.47; 184/6.25

(58) Field of Classification Search ..... 123/90.44, 123/90.46, 90.47, 90.59; 184/6.25
See application file for complete search history.

(56) References Cited

U.S. PATENT DOCUMENTS

| | | | | |
|---|---|---|---|---|
| 4,561,395 | A * | 12/1985 | McMullen | 123/196 A |
| 6,318,324 | B1 | 11/2001 | Koeroghlian et al. | |
| 6,513,472 | B2 | 2/2003 | Speil et al. | |
| 6,581,634 | B2 * | 6/2003 | Najmolhoda et al. | 137/545 |
| 7,077,090 | B2 | 7/2006 | Sailer et al. | |
| 7,089,900 | B2 | 8/2006 | Masello et al. | |
| 7,673,597 | B2 * | 3/2010 | Najmolhoda et al. | 123/90.12 |
| 2002/0108894 | A1 | 8/2002 | Owen et al. | |
| 2004/0244744 | A1 * | 12/2004 | Falkowski et al. | 123/90.16 |

FOREIGN PATENT DOCUMENTS

| | | |
|---|---|---|
| DE | 10 2004 033 500 | 2/2006 |
| DE | 10 2005 049 653 | 5/2006 |

* cited by examiner

*Primary Examiner*—Thomas E Denion
*Assistant Examiner*—Daniel A Bernstein
(74) *Attorney, Agent, or Firm*—Lucas & Mercanti, LLP

(57) ABSTRACT

The valve train assembly with magnet uses the magnet to collect ferrous metal particles that are in the oil prior to their arrival at the high pressure cavity of the hydraulic lash adjuster. The magnet can be positioned in the low pressure cavity of the hydraulic lash adjuster, in the bore of the hollow rocker arm shaft or in the bore of the hollow push rod.

5 Claims, 3 Drawing Sheets

VALVE TRAIN ASSEMBLY WITH MAGNET

FIELD OF THE INVENTION

This Invention relates to internal combustion engines and, more particularly, to valve trains and hydraulic lash adjusters used in internal combustion engines.

BACKGROUND OF THE INVENTION

Valve trains of internal combustion engines have a variety of components depending on the design of the engine, however, most modern valve trains have a valve with its associated valve stem, a hydraulic lash adjuster and a cam which actuates the valve through the valve stem.

Hydraulic lash adjusters need oil to function. Hydraulic lash adjusters have a low pressure cavity that acts as an oil reservoir and a high pressure cavity that is fed oil through a check valve positioned between the low pressure and the high pressure cavities. Typically, oil is fed to the hydraulic lash adjuster either through an inlet in the side wall or through an inlet in the top wall of the hydraulic lash adjuster. The inlet of the hydraulic lash adjuster is in fluid communication with the low pressure cavity. The inlet in the side wall is fed oil from a conduit within the engine while the inlet in the top wall is usually fed through a rocker arm. In certain configurations, the rocker arm feeds oil to the hydraulic lash adjuster by means of a hollow push rod.

In overhead cam engines with rocker arms, the cam operates on one end of a rocker arm while the other end of the rocker arm has a hydraulic lash adjuster which is mounted on the top of the valve stem. In such an arrangement, the rocker arm can be mounted on a hollow rocker arm shaft which has a bore therein for carrying oil to the rocker arm. The rocker arm also has a bore in fluid communication with the rocker arm shaft bore. The hydraulic lash adjuster is fed oil through various inlets and outlets in the rocker arm shaft bore and the rocker arm bore such that oil travels to the low pressure cavity of the hydraulic lash adjuster.

In overhead valve engines, the hydraulic lash adjuster is in contact with the cam and a hollow push rod is positioned between the top of the hydraulic lash adjuster and the rocker arm. The other end of the rocker arm is in contact with the valve stem. The hydraulic lash adjuster receives oil through the rocker arm shaft bore, the rocker arm bore and the push rod bore. The push rod bore being in fluid communication with the top inlet of the hydraulic lash adjuster, thereby feeding oil to the low pressure cavity.

In each of these arrangements, the hydraulic lash adjuster is the end of an oil passageway and metal particles which are contained within the oil can collect in the hydraulic lash adjuster and cause failure of the hydraulic lash adjuster. Such failure usually occurs when the metal particles find their way from the low pressure cavity to the high pressure cavity and jam the moving mechanisms of the hydraulic lash adjuster. Typically, these metal particles are iron or ferrous in nature. These iron particles come from machining which is done to the engine during manufacture as well as wear of the various parts in the engine.

To date, filters or screens have been positioned in the hydraulic lash adjuster to prevent the iron particles from contaminating or damaging the workings of the hydraulic lash adjuster. These filters and screens can become clogged and in certain situations are unsuitable for use in the hydraulic lash adjuster because the size of the low pressure cavity in the hydraulic lash adjuster is too small to accommodate the screens.

OBJECTIVE OF THE INVENTION

It is an object of the Invention to prevent failure of hydraulic lash adjusters from metal particles in the oil and to prevent clogging of the screens used in hydraulic lash adjusters.

SUMMARY OF THE INVENTION

The Invention achieves these objectives by placing a magnet in the passageway used to feed oil to the hydraulic lash adjuster. The magnet collects the ferrous metal particles and prevents the ferrous metal particles from entering the hydraulic lash adjuster.

Preferably, the magnet is positioned in one or more of the following locations, the push rod bore, or the rocker arm shaft bore.

In overhead cam engines that employs a hollow rocker arm shaft, it is preferred that the magnet is positioned in the rocker arm shaft bore. More preferred, the magnet is placed in the rocker arm shaft bore, upstream of the outlet in the rocker arm shaft bore for the rocker arm bore.

In overhead valve, the magnet of the present Invention is preferably positioned in either the rocker arm shaft bore or the push rod bore. Preferably, the magnet in the rocker arm shaft bore is positioned upstream of the outlet of the rocker arm shaft bore for the rocker arm bore.

Because of the fluctuations in temperature of the engine oil, suitable magnets must be able to function throughout the temperature range of the oil and in the moving oil environment. Suitable magnets are permanent magnets and, more preferably, rare earth element bearing permanent magnets, such as, $Nd_2Fe_{14}B$ permanent magnets. Synthetic magnetic rubber or plastic may be used as a magnetic element.

Suitably, the magnet is ring shaped so as to fit against the side wall of the bore or cavity in which it is placed. Suitable ways for affixing the magnet to the wall include press fitting, epoxy adhesives, or other suitable fastening techniques. In certain situations, the magnetism of the magnet itself is enough to adhere the magnet to the side wall of the bore or cavity. Additionally, the side wall of the bore or cavity can be machined to provide an indent to house the magnet, albeit, that such is not preferred because of both cost and increased possible metal particles into the oil passageway.

The magnet of the present Invention can be employed in conjuction with the filters or screens of the Prior Art hydraulic lash adjusters.

The present Invention can be defined by one or more of the following items.

Item 1

A valve train assembly for an internal combustion engine, said valve train assembly comprising:

a hydraulic lash adjuster having an internal oil cavity, a rocker arm mounted on a rocker shaft, said rocker arm having a rocker arm bore and said rocker arm shaft having a rocker arm shaft bore, wherein said internal oil cavity, said rocker arm bore and said rocker arm shaft bore are in fluid communication with each other;

an oil passageway to said internal oil cavity comprising said rocker arm bore, and said rocker arm shaft bore; and a permanent magnet positioned in said oil passageway.

Item 2

The valve train assembly of Item 1 further comprising a hollow push rod positioned between said rocker arm and said hydraulic lash assembly, said hollow push rod having a push rod bore which is in fluid communication with said rocker arm bore and said internal cavity of said lash adjuster; and said oil passageway further comprises said push rod bore.

Item 3

The valve train assembly of Item 1 wherein said magnet is positioned in said rocker arm shaft bore.

Item 4

The valve train assembly of Item 2 wherein the magnet is positioned in the push rod bore.

Item 5

The valve train assembly of Item 3 wherein said magnet is a ring mounted against a side wall of said rocker arm shaft bore and said magnet is positioned in said rocker arm shaft bore upstream of an inlet to said rocker arm bore.

Item 6

The valve train assembly of Item 2 wherein the magnet is ring shaped and is affixed to a side wall of said push rod bore.

Item 7

A method for preventing failure of a hydraulic lash adjuster of an internal combustion engine comprising:

positioning a magnet in an oil passageway used for feeding oil to a high pressure cavity of the lash adjuster.

Additional advantages and features of the present Invention may be more readily understood from the following description and the claims taken in conjunction with the following drawings.

DETAILED DESCRIPTION OF THE INVENTION

Figure 1:
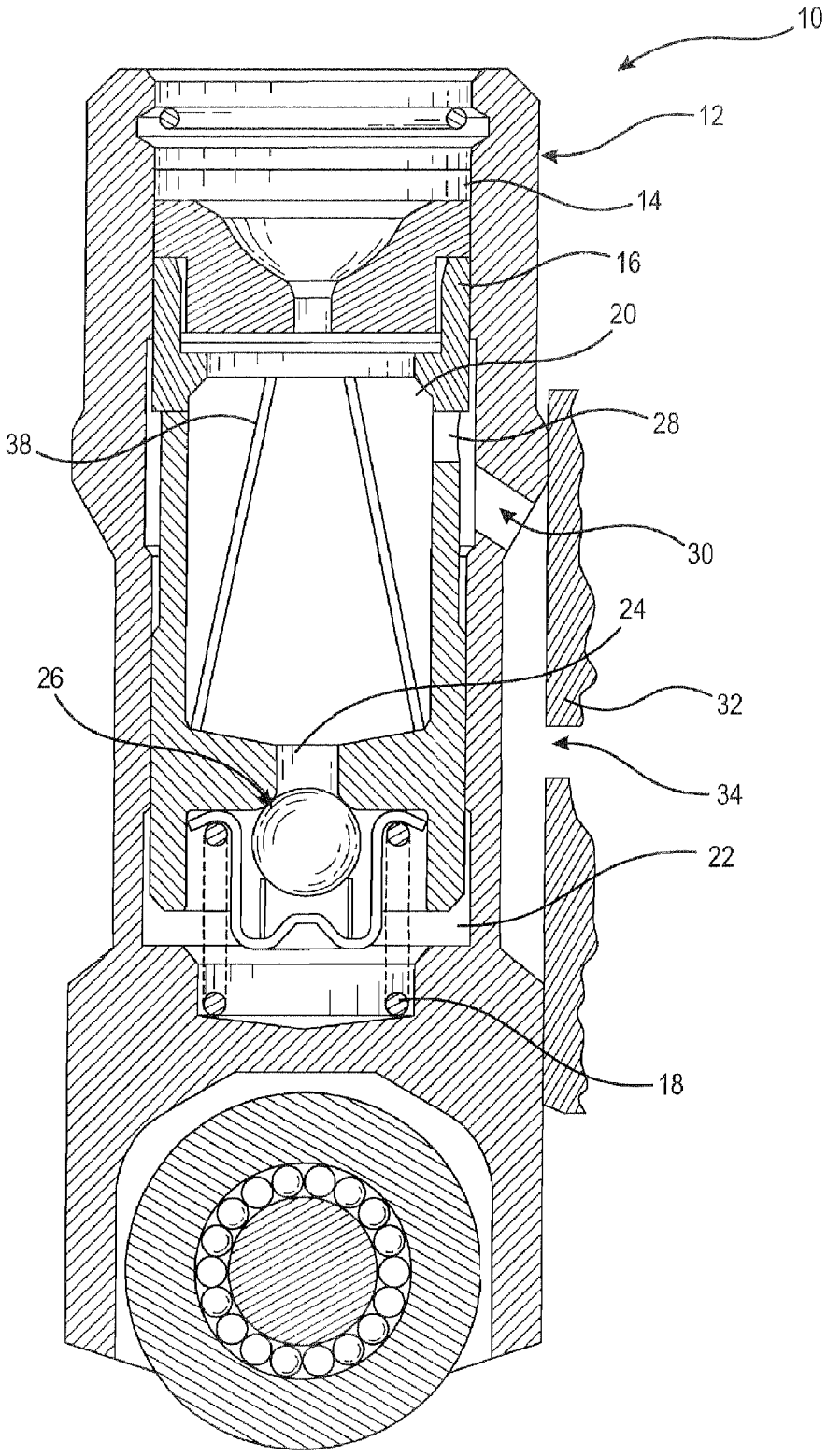
FIG. 1 illustrates a hydraulic lash adjuster.

FIG. 1 illustrates hydraulic lash adjuster 10 having body 12 with blind bore 14. Plunger 16 is slidably positioned within blind bore 14 and is urged outward by spring 18. Low pressure cavity 20 is formed in plunger 16 and high pressure cavity 22 is formed between the bottom of blind bore 14 and the bottom of plunger 16. Valve opening 24 is formed in the bottom of plunger 16 and check valve 26 is positioned to selectively open and close valve opening 24.

Low pressure cavity 20 and high pressure cavity 22 form an internal oil cavity in the hydraulic lash adjuster.

Oil enters low pressure cavity 20 through aperture 28 in the side wall of plunger 16. Oil flows to aperture 28 from inlet 30 in the side wall of body 12. Oil flows to inlet 30 through an outlet in the side wall of conduit 32 as shown by arrow 34.

As illustrated in FIG. 1, low pressure cavity 20 can also employ a screen 38 to collect metal particles from the oil.

Figure 2:
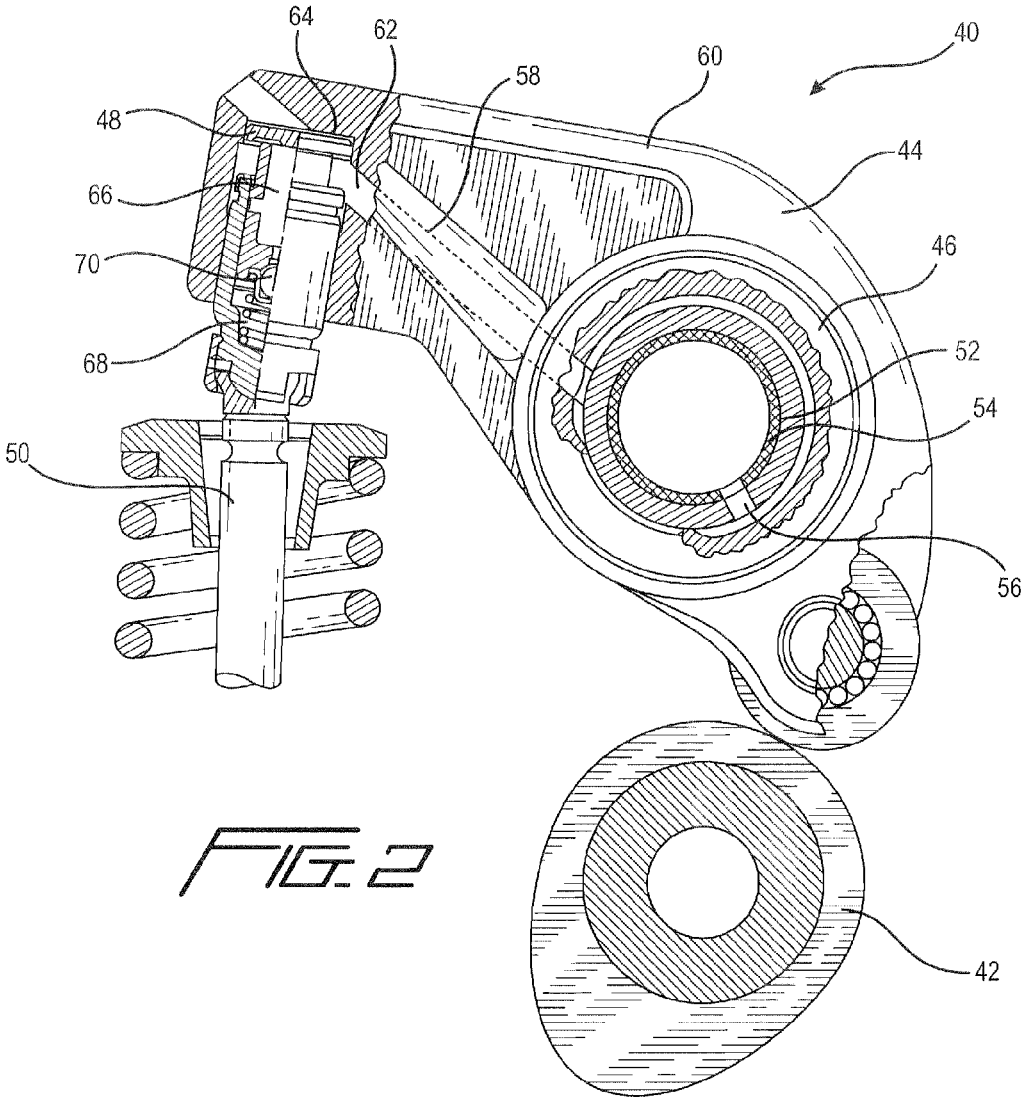
FIG. 2 illustrates an overhead cam arrangement in accordance with the present Invention.

FIG. 2 illustrates valve train 40 for an overhead cam engine. Valve train 40 comprises cam 42, rocker arm 44 which is mounted on hollow rocker arm shaft 46, hydraulic lash adjuster 48 and valve stem 50 with its respective valve.

Rocker arm shaft bore 52 is formed in hollow rocker arm shaft 46 and magnet 54 is affixed to the side wall of rocker arm shaft bore 52. Magnet 54 is ring shaped so as to fit smoothly against the side wall of rocker arm shaft bore 52. In FIG. 2, the flow of oil in rocker arm shaft bore 52 is into the paper such that magnet 54 is upstream of rocker arm shaft bore outlet 56.

Rocker arm shaft bore 52 is in fluid communication with rocker arm bore 58 by means of rocker arm shaft bore outlet 56 and rocker arm bore inlet 60.

Rocker arm bore outlet 62 is in fluid communication with hydraulic lash adjuster inlet 64. Hydraulic lash adjuster inlet 64 is in fluid communication with low pressure cavity 66 of hydraulic lash adjuster 48. Hydraulic lash adjuster 48 has high pressure cavity 68, which is separated from low pressure cavity 66 by check valve 70.

An oil passageway to low pressure cavity 66 of hydraulic lash adjuster 48 is formed in valve train 40 by rocker arm shaft bore 52 and rocker arm bore 58, and their respective inlets and outlets.

Figure 3:
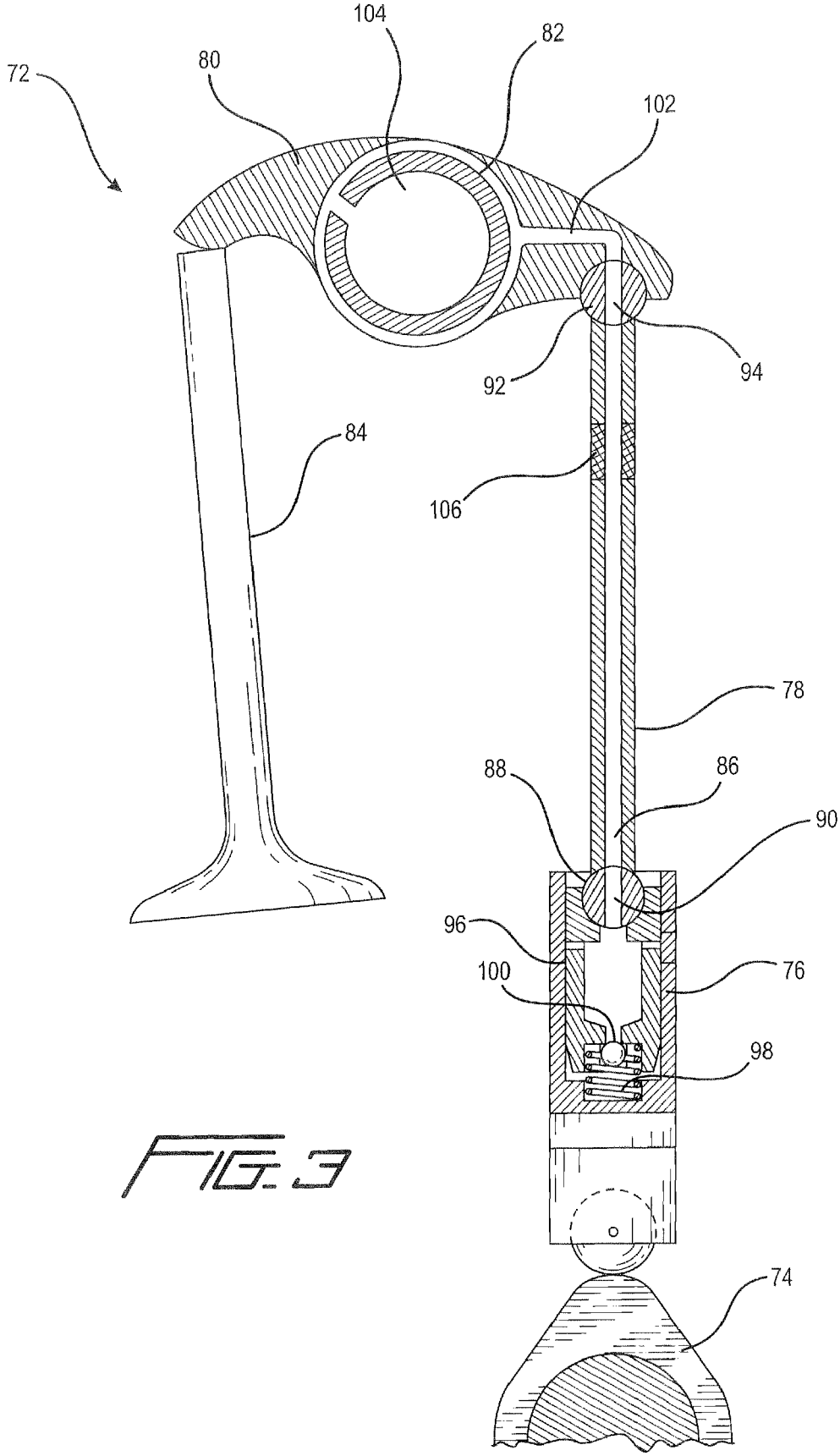
FIG. 3 illustrates an overhead valve engine cam arrangement in accordance with the present Invention.

FIG. 3 illustrates valve train 72 for an overhead valve engine, valve train 72 comprising cam 74, hydraulic lash adjuster 76, hollow push rod 78, rocker arm 80 which is mounted on hollow rocker arm shaft 82 and valve stem 84 with its respective valve.

Push rod 78 has push rod bore 86 and bearing ball 88 with its respective bearing ball bore 90 and bearing ball 92 with its respective bearing ball bore 94.

Bores 86, 90 and 94 are in fluid communication with low pressure cavity 96 of hydraulic lash adjuster 76. Low pressure cavity 96 is separated from high pressure cavity 98 by check valve 100.

Bores 86, 90 and 94 are also in fluid communication with rocker arm bore 102 and rocker arm shaft bore 104.

The oil passageway for hydraulic lash adjuster 76 can be defined as bores 86, 90, 94, 102 and 104.

As illustrated, magnet 106 is positioned in push rod bore 86 and is illustrated as actually making up part of push rod 78 so as not to restrict bore 86. Magnet 106 could also be employed as a ring adhered to the side wall of push rod bore 86 in the same manner as magnet 54 as shown in FIG. 2. Additionally, hollow push rod 78 can be completely made of magnetized material such that push rod bore 86 provides a magnetic surface throughout bore 86.

Figure 4:
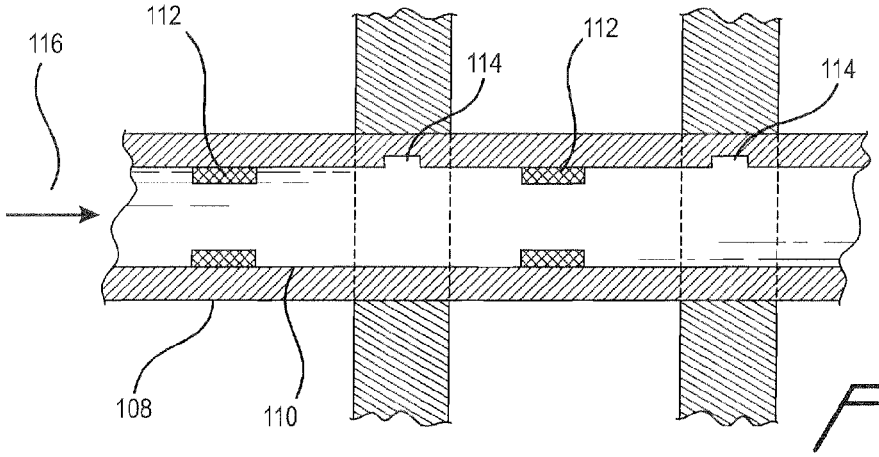
FIG. 4 illustrates a top view of a hollow rocker arm shaft in accordance with the present Invention.

FIG. 4 illustrates a top view of rocker arm shaft 108 having rocker arm shaft bore 110 therein. Magnets 112 are positioned in rocker arm shaft bore 110 upstream of inlets to rocker arm bores 114. Arrow 116 shows the oil flow through rocker arm shaft bore 110. As shown, magnets 112 are upstream of inlets to rocker arm bore 114.

While the Invention has been described in the Specification and illustrated in the drawings with a reference to a preferred embodiment, it will be understood by those of skill in the art that various changes may be made and equivalents may be substituted for elements thereof without departing from the scope of the Invention as defined in the claims. In addition, many modifications may be made to adapt a particular situation or material to the teachings of the Invention without departing from the essential scope thereof. Therefore, it is intended the Invention not be limited as particular embodiments illustrated by the drawings and described in the Specification as the best mode presently contemplated by carrying out this Invention, but that the Invention may include any embodiment falling within the description of the claims.

DESIGNATIONS

10. Hydraulic lash adjuster
12. Body
14. Blind bore
16. Plunger
18. Spring
20. Low Pressure Cavity
22. High Pressure Cavity

24. Valve Opening
26. Check valve
28. Aperature
30. Inlet
32. Conduit
34. Oil Flow
38. Screen
40. Overhead Cam Engine Valve Train
42. Cam
44. Rocker Arm
46. Hollow Rocker Arm Shaft
48. Hydraulic lash adjuster
50. Valve Stem
52. Rocker Arm Shaft Bore
54. Magnet
56. Rocker Arm Shaft Bore Outlet
58. Rocker Arm Bore
60. Rocker Arm Bore Inlet
62. Rocker Arm Bore Outlet
64. Hydraulic lash adjuster inlet
66. Low Pressure Cavity
68. High Pressure Cavity
70. Check Valve
72. Overhead valve engine Valve Train
74. Cam
76. Hydraulic lash adjuster
78. Hollow Push Rod
80. Rocker Arm
82. Hollow Rocker Arm Shaft
84. Valve Stem
86. Push Rod Bore
88. Bearing Ball
90. Bearing Ball Bore
92. Bearing Ball
94. Bearing Ball Bore
96. Low Pressure Cavity
98. High Pressure Cavity
100. Check Valve
102. Rocker Arm Bore
104. Rocker Arm Shaft Bore
106. Magnet
108. Rocker Arm Shaft
110. Rocker Arm Shaft Bore
112. Magnets
114. Rocker Arm Bore
116. Oil Flow

What is claimed is:

1. A valve train assembly for an internal combustion engine, said valve train assembly comprising:

a hydraulic lash adjuster having an internal oil cavity, a rocker arm mounted on a rocker shaft, said rocker arm having a rocker arm bore and said rocker arm shaft having a rocker arm shaft bore, wherein said internal oil cavity, said rocker arm bore and said rocker arm shaft bore are in fluid communication with each other;

an oil passageway to said internal oil cavity comprising said rocker arm bore, and said rocker arm shaft bore; and a permanent magnet positioned in said rocker arm shaft bore.

2. The valve train assembly of claim 1 wherein said magnet is a ring mounted against a side wall of said rocker arm shaft bore and said magnet is positioned in said rocker arm shaft bore upstream of an inlet to said rocker arm bore.

3. A valve train assembly for an internal combustion engine, said valve train assembly comprising:

a hydraulic lash adjuster having an internal oil cavity, a rocker arm mounted on a rocker shaft, said rocker arm having a rocker arm bore and said rocker arm shaft having a rocker arm shaft bore, wherein said internal oil cavity, said rocker arm bore and said rocker arm shaft bore are in fluid communication with each other;

an oil passageway to said internal oil cavity comprising said rocker arm bore, and said rocker arm shaft bore;

a permanent magnet positioned in said oil passageway; and a hollow push rod positioned between said rocker arm and said hydraulic lash assembly, said hollow push rod having a push rod bore which is in fluid communication with said rocker arm bore and said internal oil cavity; and said oil passageway further comprises said push rod bore, the magnet being positioned in the push rod bore.

4. The valve train assembly of claim 3 wherein the magnet is ring shaped and is affixed to a side wall of said push rod bore.

5. A method for preventing failure of a hydraulic lash adjuster of an internal combustion engine comprising:

positioning a magnet in a rocker arm shaft bore of an oil passageway used for feeding oil to a high pressure cavity of the lash adjuster.

* * * * *